US010196847B2

(12) United States Patent
Miglioranzo

(10) Patent No.: US 10,196,847 B2
(45) Date of Patent: Feb. 5, 2019

(54) HYDRAULIC HINGE, IN PARTICULAR CONCEALED HINGE FOR DOORS

(71) Applicant: Ivano Miglioranzo, Valeggio sul Mincio (IT)

(72) Inventor: Ivano Miglioranzo, Valeggio sul Mincio (IT)

(73) Assignee: OL.MI S.R.L., Castelnuovo (IT)

( * ) Notice: Subject to any disclaimer, the term of this patent is extended or adjusted under 35 U.S.C. 154(b) by 226 days.

(21) Appl. No.: 15/280,490

(22) Filed: Sep. 29, 2016

(65) Prior Publication Data

US 2017/0016261 A1 Jan. 19, 2017

Related U.S. Application Data

(62) Division of application No. 14/424,015, filed as application No. PCT/IB2014/063556 on Jul. 30, 2014, now Pat. No. 9,500,018.

(30) Foreign Application Priority Data

Jul. 30, 2013 (IT) ..... VI2013A0195

(51) Int. Cl.

| | |
|---|---|
| ***E05F 3/20*** | (2006.01) |
| ***E05F 3/10*** | (2006.01) |
| ***E05D 7/08*** | (2006.01) |
| ***E05D 11/08*** | (2006.01) |
| ***E05F 5/02*** | (2006.01) |
| ***E05F 5/10*** | (2006.01) |

(52) U.S. Cl.

CPC ..... *E05F 3/20* (2013.01); *E05D 7/08* (2013.01); *E05D 11/081* (2013.01); *E05F 3/102* (2013.01);

(Continued)

(58) Field of Classification Search

CPC ..... E05F 5/02; E05F 5/10; E05F 3/04; E05F 3/108; E05F 3/102; E05F 3/12; E05F 3/20; E05D 7/08; E05D 11/081; E05D 3/122; Y10T 16/2771; Y10T 16/304; Y10T 16/2788; Y10T 16/2804; Y10T 16/293; Y10T 16/61; Y10T 16/625; Y10T 16/577;

(Continued)

(56) References Cited

U.S. PATENT DOCUMENTS 3,426,383 A * 2/1969 Pollack ..... E05F 3/102 16/62
3,546,734 A * 12/1970 Pollack ..... E05F 3/102 16/52

(Continued)

*Primary Examiner* — William L Miller
(74) *Attorney, Agent, or Firm* — Mark David Torche; Patwrite Law

(57) ABSTRACT

A hinge for the controlled rotatable movement of a closing element, such as a door, a door leaf or the like, anchored to a stationary support structure, such as a wall, a floor, a frame or the like. The hinge comprises a hinge body and a pivot defining a first axis reciprocally coupled to allow the closing element to rotate between an open position and a closed position. The hinge further comprises a working chamber defining a second axis substantially perpendicular to said first axis and a plunger element sliding within the working chamber along the second axis between a position proximal to the bottom wall of the working chamber and a position distal therefrom. The pivot includes a pinion member, whereas the plunger element includes a rack member engaged with the pinion member.

20 Claims, 11 Drawing Sheets

(52) U.S. Cl.
CPC ..... *E05F 3/108* (2013.01); *E05F 5/02* (2013.01); *E05F 5/10* (2013.01); *E05Y 2900/132* (2013.01); *Y10T 16/2771* (2015.01)

(58) Field of Classification Search
CPC ..... Y10T 16/541; Y10T 16/2766; E05Y 2900/132
USPC ..... 16/54, 50, 82, 58, 85, 62, 64, 79, 354, 16/52; 49/358, 381; 188/295, 322.5
See application file for complete search history.

(56) References Cited

U.S. PATENT DOCUMENTS 4,019,220 A * 4/1977 Lieberman ..... E05F 3/102 16/59
4,234,996 A * 11/1980 Jentsch ..... E05F 3/102 16/52
4,394,787 A * 7/1983 Lieberman ..... E05F 3/102 16/58
4,502,180 A * 3/1985 Harrison ..... E05F 3/102 16/52
5,265,306 A * 11/1993 Yu ..... E05F 3/10 16/51
6,681,525 B1 * 1/2004 Dudley ..... E05F 3/102 16/62
7,007,342 B2 * 3/2006 Huang ..... E05F 3/102 16/52
7,815,023 B2 * 10/2010 Salutzki ..... C08L 59/02 16/52
9,097,051 B2 * 8/2015 Hellwig ..... E05F 3/10
9,765,558 B2 * 9/2017 Talpe ..... E05F 3/108
9,803,410 B2 * 10/2017 Miglioranzo ..... E05D 3/186

* cited by examiner

HYDRAULIC HINGE, IN PARTICULAR CONCEALED HINGE FOR DOORS

CROSS REFERENCE TO RELATED APPLICATIONS

This application is a divisional, of application Ser. No. 14/424,015, filed on Feb. 25, 2015, now pending, which is a U.S. national stage entry from co-pending International Patent Application Ser. No. PCT/IB2014/063556, filed Jul. 30, 2014 and claims priority to Italian patent application No. V12013A000195 filed Jul. 30, 2013, the entire contents of both of all are hereby incorporated by reference.

DESCRIPTION

Field of the Invention

The present invention is generally applicable to the technical field of the closing or control hinges, and particularly relates to a hinge for rotatably moving a door, a door leaf or the like.

State of the Art

Closing hinges are known which comprise a box-shaped hinge body and a pivot coupled each other to allow a closing element, such as a door, a door leaf or the like, to rotate between an open position and a closed position.

Generally, such hinges include a hinge body and a pivot mutually coupled each other to allow the closing element to rotate between the open and closed positions.

These known hinges further include a working chamber within the box-shaped hinge body which slidably houses a plunger member.

These hinges are susceptible of improvement. In fact, in the event of a sudden opening of the door, there is a danger that the same door goes for impact against the frame which supports it, by damaging itself.

SUMMARY OF HE INVENTION

Object of the present invention is to at least partially overcome the above drawbacks, by providing a high functional and low cost hinge.

Another object of the invention is to provide a hinge that allows the control of the closing element both during closing and opening.

Another object of the invention is to provide a hinge of limited bulkiness.

Another object of the invention is to provide a hinge which ensures the automatic closing of the closing element from the open door position.

Another object of the invention is to provide a hinge that is capable of supporting also very heavy closing elements, without changing its behavior.

Another object of the invention is to provide a hinge which has a minimum number of constituent parts.

Another object of the invention is to provide a hinge capable of maintaining the exact closing position with time.

Another object of the invention is to provide a hinge extremely safe.

Another object of the invention is to provide a hinge extremely easy to install.

These objects, and others which will appear more clearly hereinafter, are achieved by a hinge in accordance with what is herein described, claimed and/or shown.

Advantageous embodiments of the invention are defined according to the dependent claims.

BRIEF DESCRIPTION OF THE DRAWINGS

Further features and advantages of the invention will appear more evident upon reading the detailed description of some preferred, non-exclusive embodiments of a hinge 1, which are described as non limiting examples with the help of the annexed drawings, in which.

DETAILED DESCRIPTION OF A PREFERRED EMBODIMENT

Figure 1:
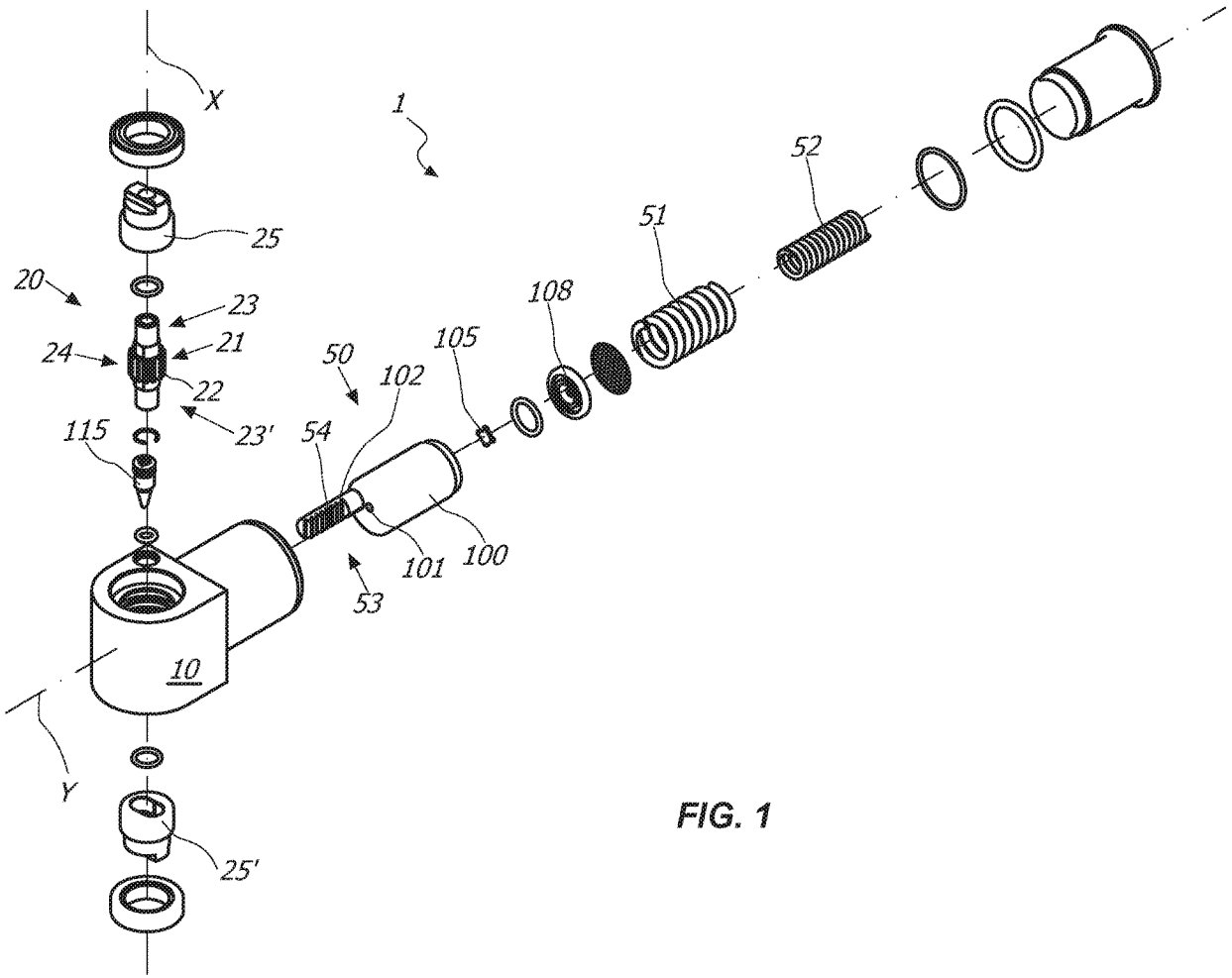
FIG. 1 is an exploded isometric view of an embodiment of the hinge 1.

With reference to the above figures, the hinge 1 is advantageously used for the controlled rotatable movement of at least one closing element, such as a door, a door leaf or the like, which may be in a per se known manner anchored to a stationary support structure, such as a wall, a floor, a frame or the like.

The attached figures do not show the closing element nor the stationary support structure, since they are per se known. It is understood that both such elements are not part of the invention claimed in the appended claims.

Therefore, the hinge 1 includes a box-shaped hinge body 10 which can be anchored to one of the stationary support structure and the closing element, and a pivot 20 which can be anchored to the other of the stationary support structure and the closing element.

In all the embodiments shown in the attached figures the box-shaped hinge body 10 is anchored to the stationary support structure, while the pivot 20 is anchored to the closing element. However, it is understood that the box-shaped hinge body 10 may be anchored to the closing element, while the pivot 20 may be anchored to the stationary support structure without departing from the scope of the appended claims.

Suitably, the pivot 20 and the box-shaped hinge body 10 are mutually coupled each other to rotate around the axis X, which for example may be substantially vertical.

Suitably, the axis X may further define the axis of rotation of the closing element.

The hinge 1 further includes a working chamber 40 defining an axis Y, which may be substantially horizontal. Within the working chamber 40, which may be internal to the box-shaped hinge body 10, a plunger member 50 operatively connected to the pivot 20 may slide along the axis Y.

Depending on the configuration of the plunger member 50, the hinge 1 may be a closing hinge or a control hinge.

The plunger member 50 may include or not elastic counteracting means. Depending on their configuration, these elastic counteracting means may include a biasing spring, i.e. a spring which is adapted to return the closing element towards the closed position from the open one or vice-versa, or a reset spring, i.e. a spring which is adapted to restore the original position of the plunger member 50 but is not suitable to return the closing element in the closed position from the open one or vice-versa.

For example, in the embodiments shown in FIGS. 1 to 5*b* and 6 to 8*b* the elastic counteracting means may respectively include a pair of helical biasing springs 51, 52 or a single helical biasing spring 51.

Figure 13:
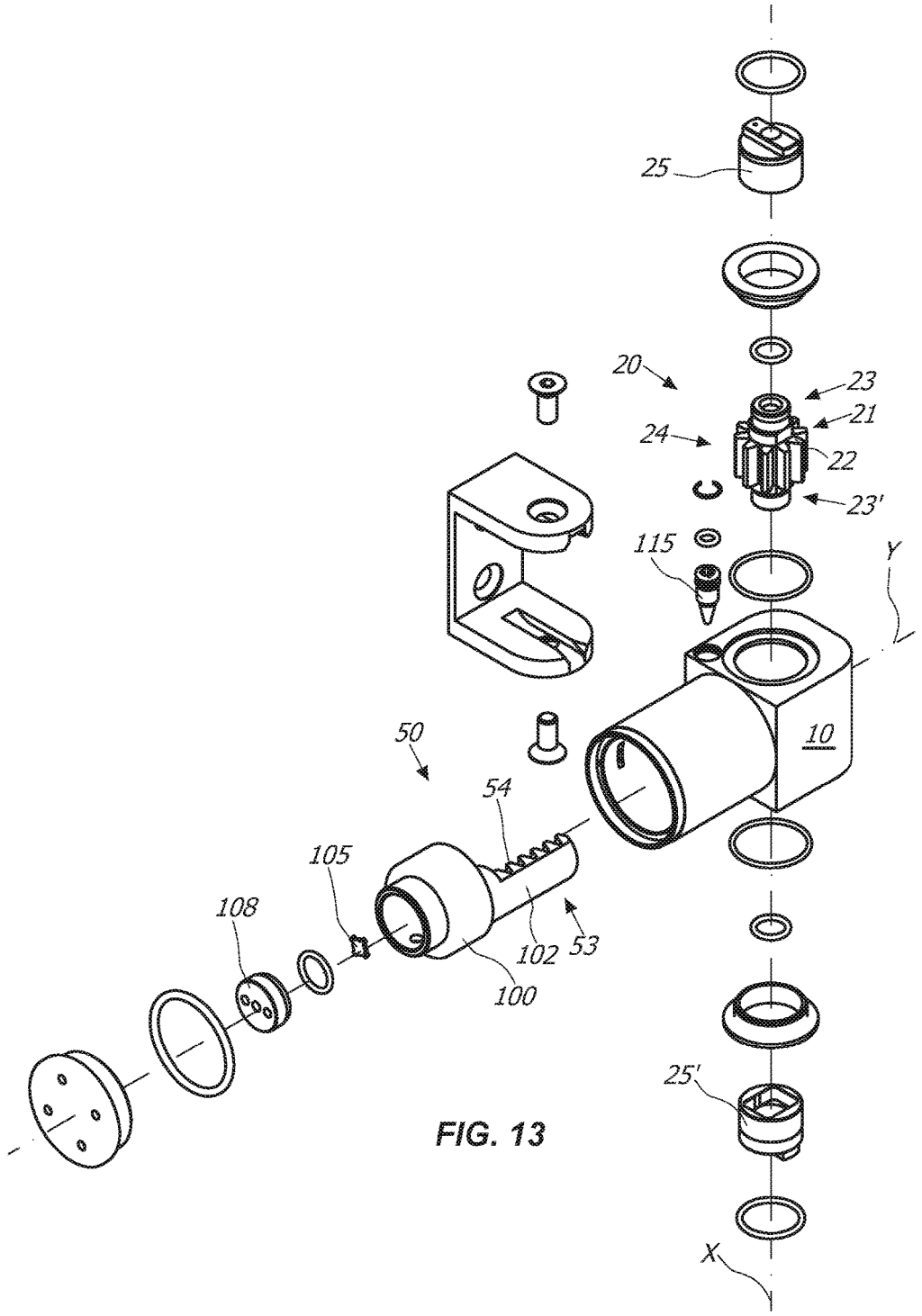
FIG. 13 is an exploded isometric view of another embodiment of the hinge 1.
Figure 14A:
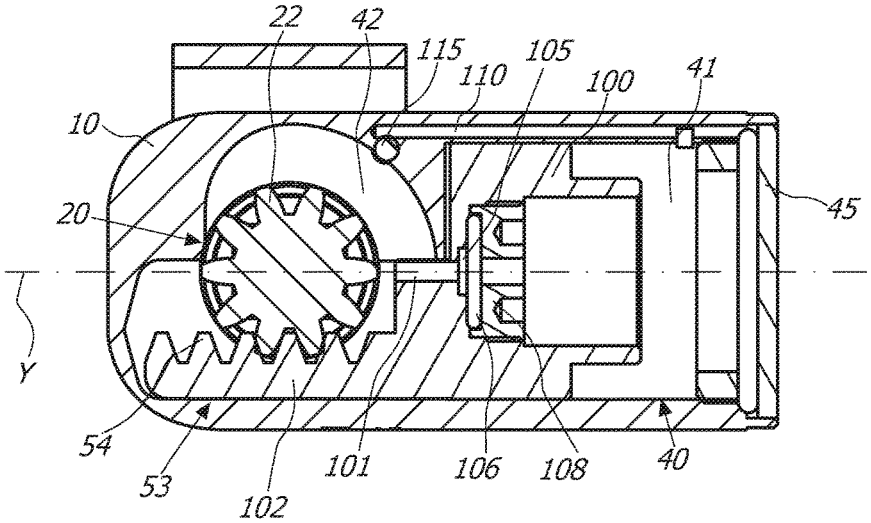
FIGS. 14*a* and 14*b* are axially sectioned views of the embodiment of the hinge 1 of FIG. 13, in which the closing element is respectively in the closed and open position.
Figure 14B:
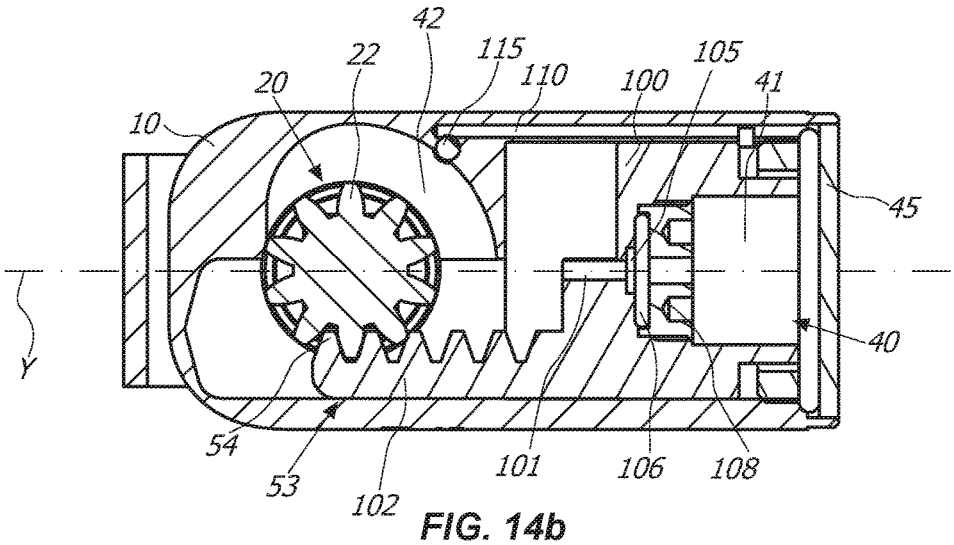

On the other hand, in the embodiment shown in FIGS. 13 to 14*b* the hinge 1 may be free of elastic counteracting means.

Irrespective of the presence or not of the elastic counteracting means, the plunger member 50 may include a cylindrical body 100, preferably tightly inserted in the working chamber 40.

In this way, the plunger member 50 can slide along the axis Y between a position proximal to the bottom wall 45 of the working chamber 40 and a position distal therefrom. In the embodiments shown in the figures, the proximal position corresponds to the open position of the closing element, while the distal position corresponds to the closed position of the closing element.

Where present, the proximal position corresponds to the maximum compression of the elastic counteracting means 51 or 51, 52, while the distal position corresponds to the maximum elongation thereof.

The pivot 20 and the plunger member 50 may be engaged with each other so that the rotation of the former about the axis X corresponds to the sliding of the latter along the axis Y between the proximal and distal positions, and vice-versa the sliding of the latter along the axis Y between the proximal and distal positions corresponds to the rotation of the former around the axis X.

To this end, the pivot 20 may include a pinion member 21 with a plurality of first shaped teeth 22, while the plunger member 50 may include a rack member 53 substantially parallel to the axis Y comprising a plurality of second countershaped teeth 54.

Figure 2:
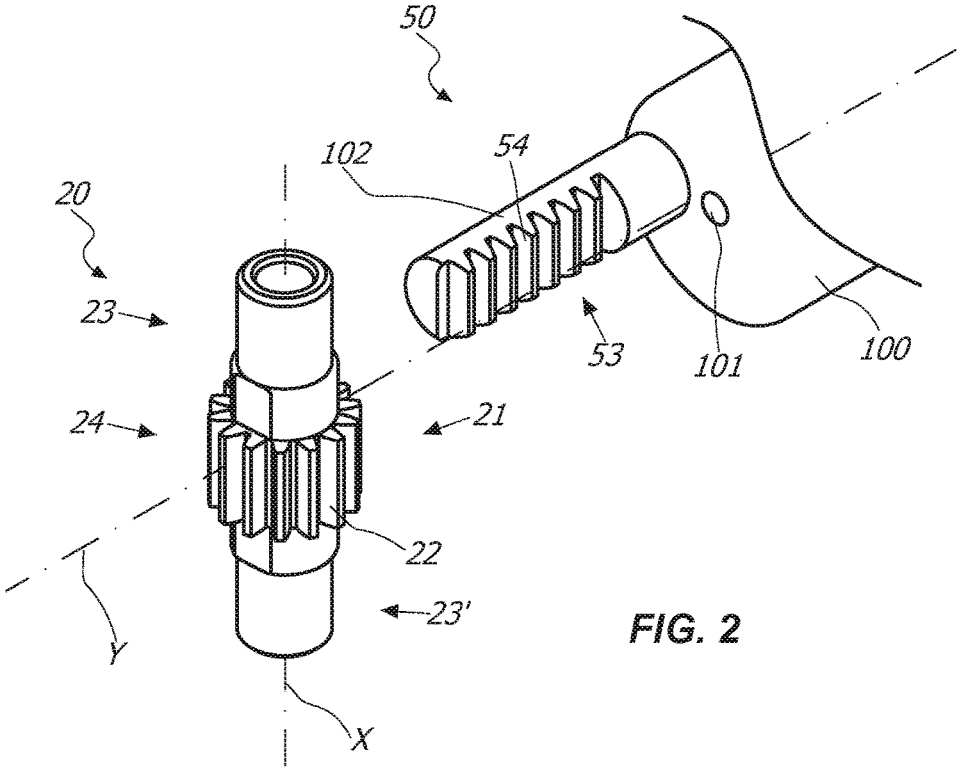
FIGS. 2 and 3 are isometric views of some details of the embodiment of the hinge 1 of FIG. 1.
Figure 3:
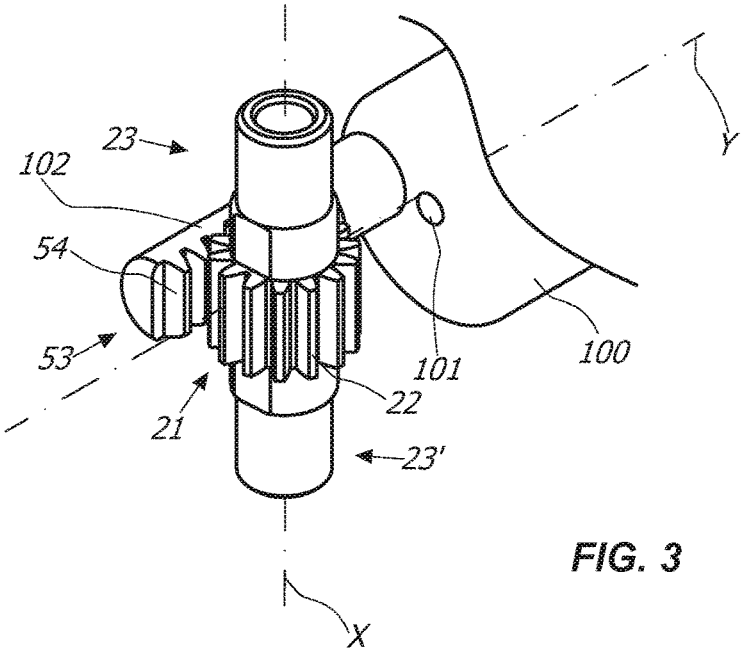

As particularly shown in FIGS. 2 and 3, the first shaped teeth 22 of the pivot 20 and the second countershaped teeth 54 of the plunger member 50 are operatively coupled to each other. In this way, the pivot 20 and the plunger member 50 are always engaged each other, so as to obtain maximum control of the closing element both during opening and closing.

In fact, in case of sudden opening, for example due to a gust of wind or a careless user, the engagement of the pivot 20 and the plunger member 50 prevents the closing element to move freely going to impact against its frame, thus unavoidably damaging.

This makes the hinge 1 extremely safe and reliable.

In the preferred but not exclusive embodiments shown in FIGS. 1 to 5*b* and 13 to 14*b*, the pivot 20 may include a pair of end connection portions 23, 23' anchored to the closing element, so that the axis X defines the axis of rotation of the latter. The connection can be done by a pair of anchoring elements 25, 25' connected to the end portions 23, 23' of the pivot 20.

On the other hand, in the preferred but not exclusive embodiment shown in FIGS. 6 to 8*b*, the pivot 20 may include a single connecting end portion 23, anchored to the closing element.

Moreover, the pivot 20 may further include at least one central operating portion 24 within the working chamber 40 including the pinion member 21.

Advantageously, the first shaped teeth 22 can be distributed along the periphery of the operating portion 24 of the pivot 20, suitably having cylindrical shape, for its entire circumference.

In other words, the central operating portion 24 may define a real gear wheel, designed to engage with the rack member 53.

On the other hand, the latter can be defined by an elongated element 102 unitary with the cylindrical body 100 and substantially parallel to the axis Y. The elongated element 102 may include the second countershaped teeth 54. Therefore the rack member 53 unitary slides with the cylindrical body 100 along the axis Y between the proximal and distal positions, so as to define a real linear gear engaged with the toothed wheel defined by the operating portion 24.

In the preferred but not exclusive embodiments shown in FIGS. 1 to 5*b* and 13 to 14*b*, the elongate element 102 may be monolithic with the cylindrical body 100, while in the preferred but not exclusive embodiment shown in FIGS. 6 to 8*b*, the elongate element 102 may be unitary with the same cylindrical body 100 by means of the shaft 30 inserted therein.

By properly configuring the pinion member 21 and the rack member 53, it is possible to allow the pivot 20 to rotate for at least 180°. This allows an equal opening amplitude of the closing element.

The hinge 1 may be mechanical or hydraulic.

Therefore, the working chamber 40 may suitably include a working fluid, generally oil, acting on the plunger member 50 to counteract the action thereof, thus hydraulically controlling the closing or opening movement of the closing element.

The cylindrical body 100 acts as separation element of the working chamber 40 in a first and a second variable volume compartments 41, 42. The latter, which will be fluidically communicating each other, are preferably adjacent.

Advantageously, the first and the second variable volume compartments 41, 42 may be configured to have in correspondence with the closed position of the closing element respectively the maximum and the minimum volume. To this end the elastic counteracting means 51 or 51, 52, if present, may be placed in the first compartment 41.

Suitably, the cylindrical body 100 may be tightly inserted in the working chamber 40.

As used herein, the term "cylindrical body tightly inserted" and derivatives thereof means that the cylindrical body 100 is inserted in the working chamber with a minimum clearance, such as to enable it to slide along the same working chamber but such as to prevent passages of the working fluid through the interspace between the side surface of the cylindrical body and the inner surface of the working chamber.

In a preferred but not exclusive embodiment, the cylindrical body 100 may include at least one first passage 101 to allow the passage of the working fluid between the first and the second compartments 41, 42 upon one of the opening or closing of the at least one closing element.

To allow the passage of the working fluid between the first and the second compartments 41, 42 upon the other of the opening or closing of the at least one closing element, a circuit 110 may be provided.

In the preferred but not exclusive embodiments shown in the attached figures, upon the opening of the closing element the working fluid passes from the first compartment 41 to the second compartment 42 through the opening 101, while upon the closing of the closing element the working fluid passes from the second compartment 42 to the first compartment 41 through the circuit 110.

However, it is understood that upon opening of the closing element the working fluid may pass from the first compartment 41 to second compartment 42 through the circuit 110, while upon the closing of the closing element the working fluid may move from the second compartment 42 to the first compartment 41 through the opening 101 without departing from the scope of protection defined by the attached claims.

It may further be provided that upon opening of the closing element the working fluid may pass from the second compartment 42 to the first compartment 41 through one of the circuit 110 and the at least one opening 101, while upon the closing of the closing element the working fluid may pass from the first compartment 41 to second compartment 42 through the other of the circuit 110 and the at least one opening 101, without departing from the scope of protection defined by the attached claims.

A screw or nozzle 115 may further be provided for regulating the passage section of the circuit 110, so as to regulate the return speed of the working fluid.

Figure 11:
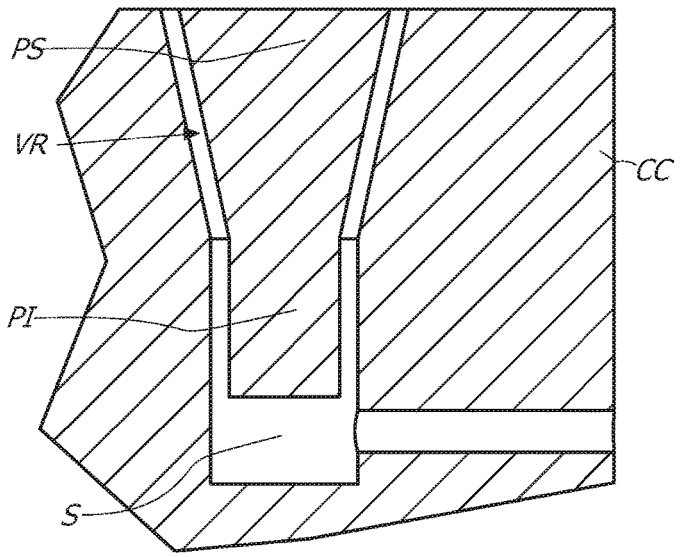
FIG. 11 is a sectional split view of a regulating screw for regulating the flow of working fluid within the hydraulic circuit of a hinge belonging to the state of the art.

FIG. 11 shows an adjusting screw VR belonging to the state of the art. In a per se known manner, this adjustment screw VR includes a substantially cylindrical upper portion PS and a substantially conical lower portion PI, and is adapted to be inserted in a substantially countershaped seat S. In a per se known manner, the upper portion PS is anchored in the hinge body CC.

In case of high pressures in the working chamber, this type of adjustment screw VR does not ensure the maintenance of the original position over time, and therefore does not ensure the constancy in the behavior of the closing element during the closing and/or opening movement. In particular, the high pressure may lead to misalignments of the adjusting screw.

Figure 12:
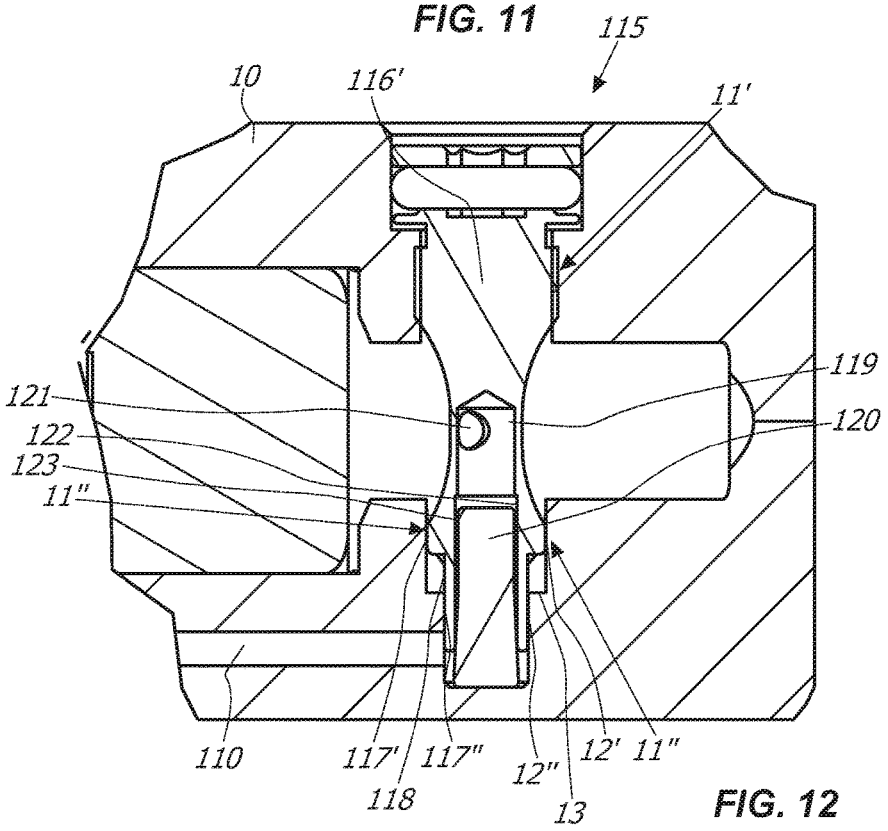
FIG. 12 is an enlarged sectional split view of certain details of FIG. 10.

To overcome this drawback, in a preferred but not exclusive embodiment shown for example in FIG. 12, the adjustment screw 115 may have a first upper threaded end 116' which can be screwed into a corresponding first upper counterthreaded connecting portion 11' of the hinge body 10 and a second lower end 116" slidably inserted in a corresponding second lower guide portion 11' of the hinge body 10.

To do this, the second lower end 116" of the adjustment screw or nozzle 115 may have at least one portion 117', 117" of its outer surface 118 abutting against at least one corresponding portion 12', 12" of the inner surface 13 of the second lower guide portion 11' of the hinge body 10.

In this way, the vertical sliding of the adjustment screw 115 is always guided, thus totally avoiding the danger of misalignment thereof.

Advantageously, the second lower end 116" may include a hollow seat 119 for housing a substantially frustoconical element 120 coaxially inserted therein.

The adjustment screw 115 may include a first opening 121 for the inlet/outlet of the working fluid, placed preferably at a substantially central portion thereof.

Suitably, the inner surface 122 of the hollow seat 119 may be facing the outer surface 123 of the substantially frustoconical element 120 to define an interspace fluidically connected to the first opening 121 and the circuit 110, and interposed therebetween.

In order to regulate the flow of the working fluid, the interspace may have variable volume.

To this end, the hollow seat 119 may have a substantially cylindrical shape, while the substantially frustoconical element 120 may have the smaller end facing the first opening 121.

This way, the unscrewing/screwing of the first upper end 116' of the adjustment screw 115 from/in the first upper connecting portion 11' of the hinge body 10 corresponds to the mutual distancing/approaching of the substantially frustoconical element 120 and the adjusting screw 115, thus varying the volume of the interspace.

This allows regulation of the flow of the working fluid through the circuit 110 in a simple and quick manner, by maximally ensuring the constancy over time of the behavior of the closing element during the closing and/or opening movement.

It is understood that the described adjustment screw 115, shown for example in FIG. 12, may be used in any hydraulic hinge, not necessarily the one shown in FIGS. 1 to 8*b* and 13 to 14*b*. For example, the adjustment screw 115 can be used in a hinge made according to the teachings of the international patent application WO2012/150507.

Advantageously, the cylindrical body 100 may further include valve means, which can consist of a non-return valve 105, interacting with the passing-through hole 101 to selectively prevent the passage of the working fluid therethrough upon the closure of closing element, thus forcing the passage of the working fluid through the circuit 110.

The non-return valve 105 may further be configured to selectively allow the passage of the working fluid through the passing-through hole 101 upon opening of the closing element.

In the preferred but not exclusive embodiment shown in FIGS. 6 to 8*b*, the hinge 1 may include a shaft 30 connected to the cylindrical body 100 by a screw 31. The shaft 30 may be monolithically connected to the rack member 53. The valve 105 may move in a seat 106 defined between the cylindrical body 100 and the interface element 107. More details on the configuration of these elements, and in particular on the configuration of the hole 101, the non-return valve 105 and the mechanical connection between the cylindrical body 100, the shaft 30 and the interface element 107, are shown in the international application PCT/IB2012/051006, on behalf of the same Applicant, which is referred to for consultation.

In the preferred but not exclusive embodiments shown in FIGS. 1 to 5*b* and 13 to 14*b*, the valve 105 may move in a seat 106 defined between the cylindrical body 100 and the valve body 108.

Thanks to these features, it is possible to effectively control the flow of the working fluid between the first and the second compartments 41, 42 in both directions.

The valve body 108 may have any configuration.

Figure 4A:
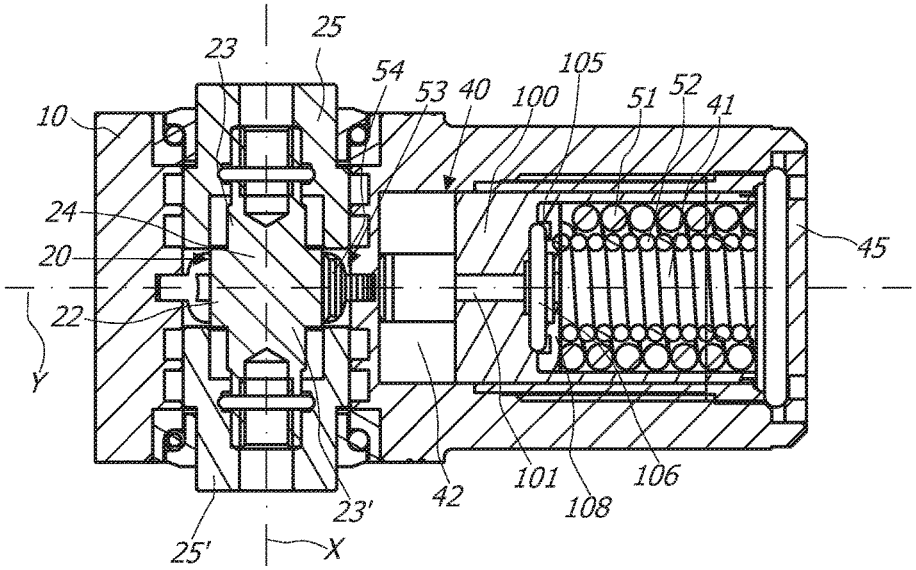
FIGS. 4*a* and 4*b* are axially sectioned views of the embodiment of the hinge 1 of FIG. 1, in which the closing element is respectively in the open and the closed position.
Figure 4B:
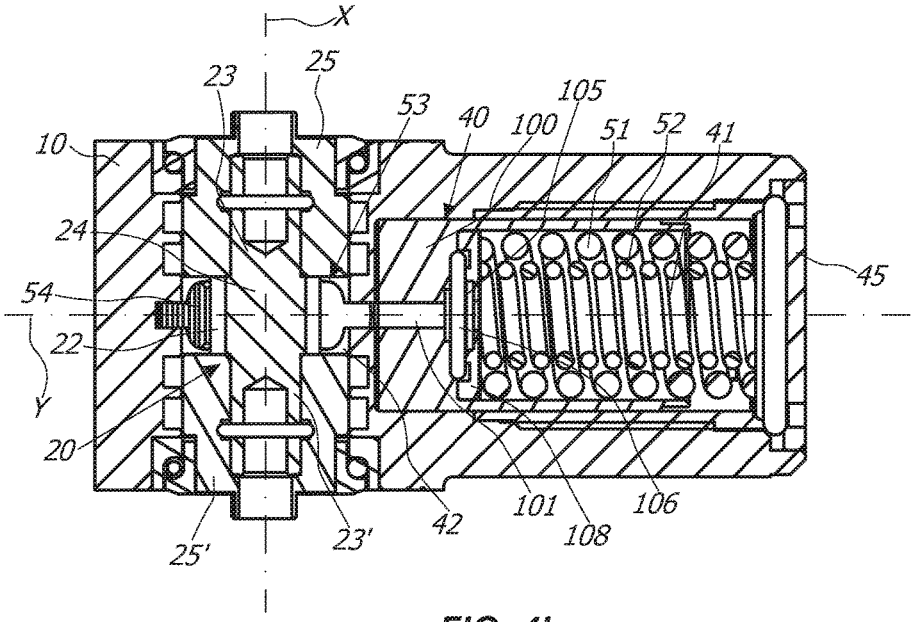
Figure 5A:
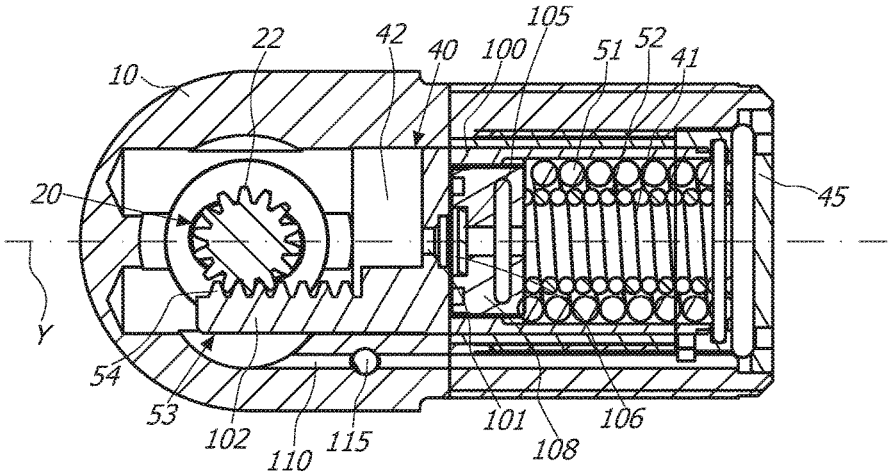
FIGS. 5*a* and 5*b* are axially sectioned views of the embodiment of the hinge 1 of FIG. 1, in which the closing element is respectively in the open and the closed position, in which the valve body 108 has an alternative configuration with respect to that in FIGS. 1, 4*a* and 4*b;*
Figure 5B:
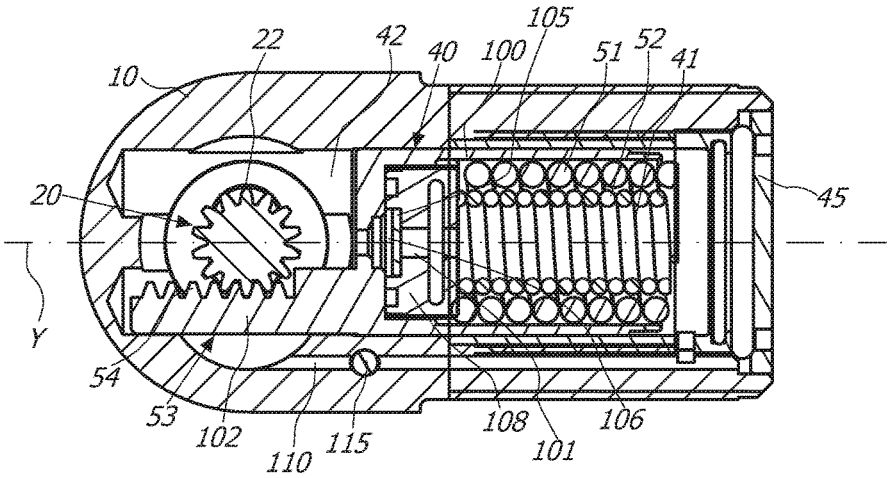
Figure 6:
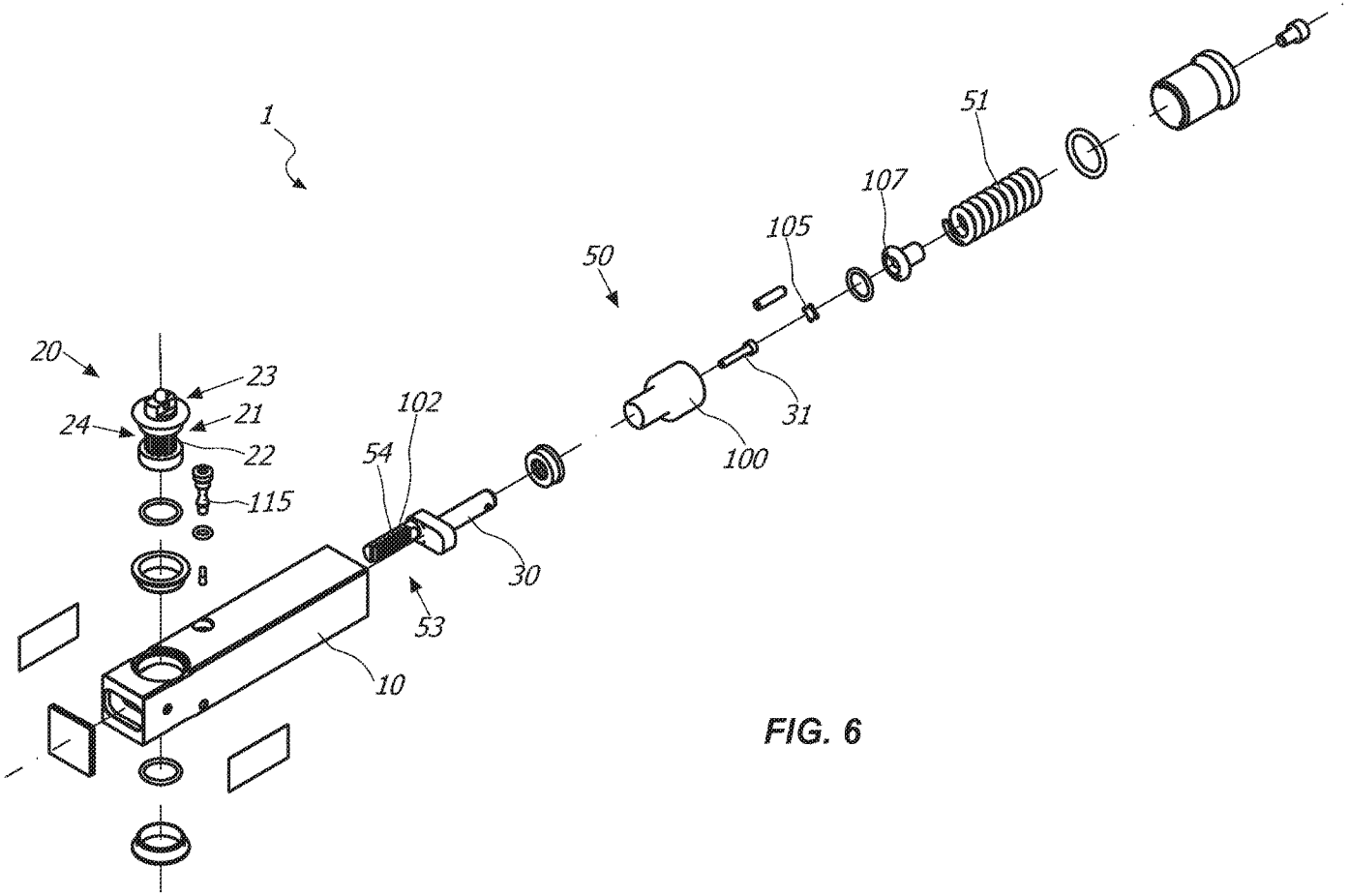
FIG. 6 is an exploded isometric view of a further embodiment of the hinge 1.
Figure 7A:
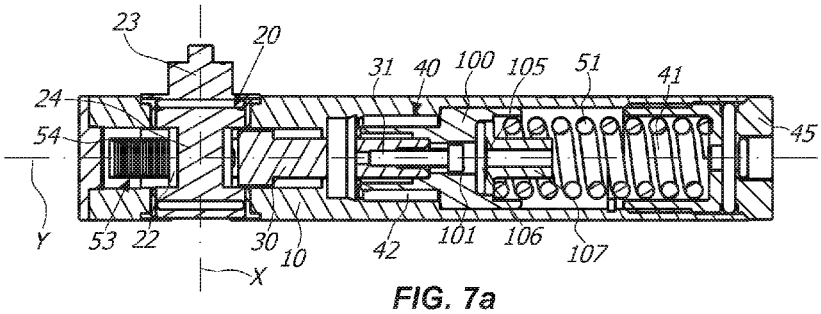
FIGS. 7*a* and 7*b* are axially sectioned views of the embodiment of the hinge 1 of FIG. 6, both according to a vertical and horizontal section plane, in which the closing element is in the closed position.
Figure 7B:
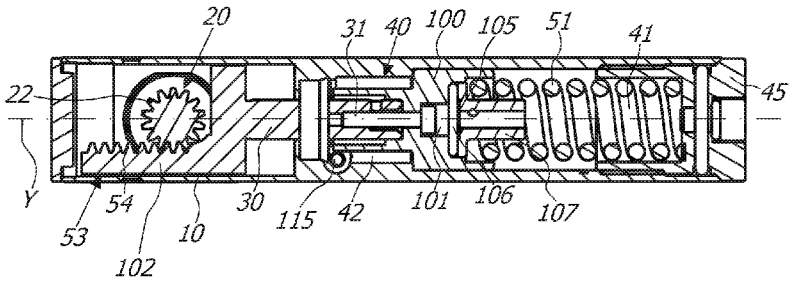
Figure 8A:
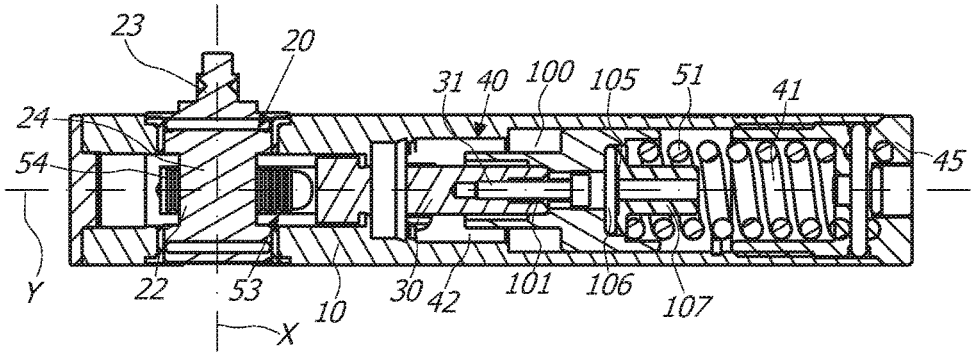
FIGS. 8*a* and 8*b* are axially sectioned views of the embodiment of the hinge 1 of FIG. 6, both in a vertical and horizontal plane, in which the closing element is in the open position.
Figure 8B:
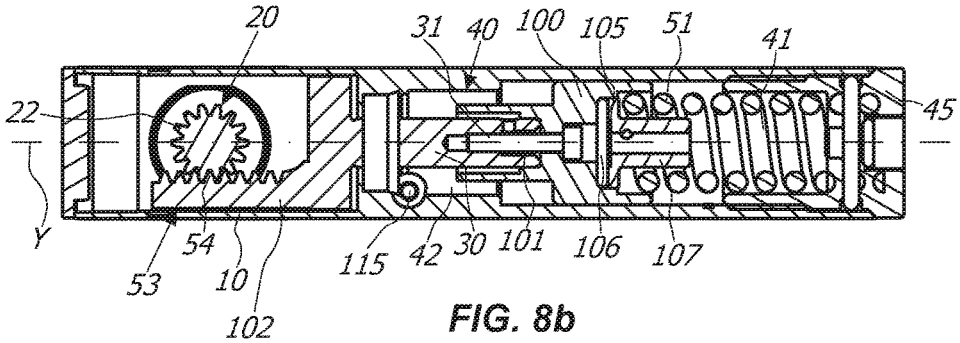
Figure 9:
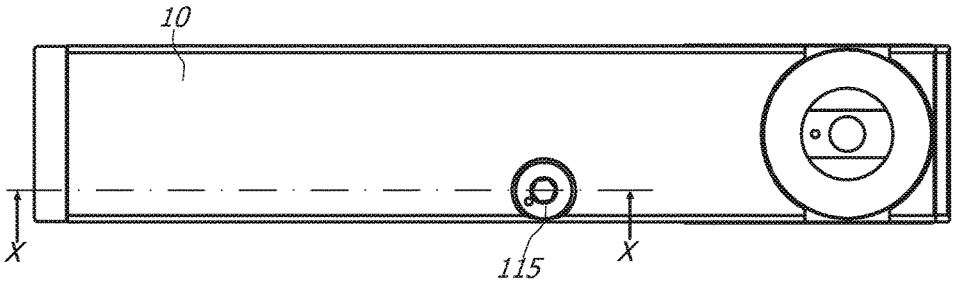
FIG. 9 is a top view of the embodiment of the hinge 1 of FIG. 6.
Figure 10:
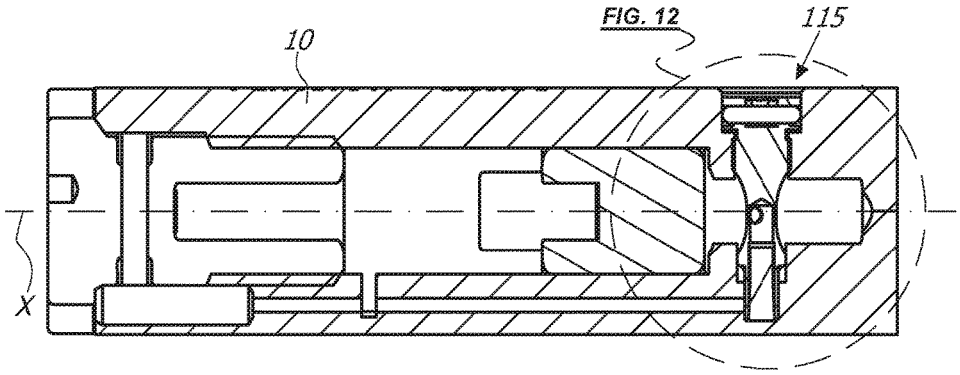
FIG. 10 is a section view of some details of the embodiment of the hinge 1 of FIG. 6 taken along a plane X-X in FIG. 9.

In particular, as shown for example in FIGS. 4*a* and 4*b*, it may be removably connectable to the cylindrical body 100, and can be maintained in operative position by the elastic counteracting means 51 or 51, 52.

On the other hand, as shown for example in FIGS. 5*a*, 5*b*, 14*a* and 14*b*, it can be irremovably fixed to the cylindrical body 100, for example screwed therein. This solution is particularly preferred when the hinge 1 is free of the elastic counteracting means.

From the above description, it is apparent that the hinge according to the invention fulfils the intended objects.

The hinge of the invention is susceptible of numerous modifications and variations, all within the inventive concept expressed in the attached claims. All the details may be replaced with other technically equivalent elements, and the materials may be different according to requirements, without departing from the scope of the invention.

Even if the hinge has been described with particular reference to the attached figures, reference numbers used in the description and in the claims are used only to improve the intelligence of the invention and do not constitute any limitation of the claimed scope.

What is claimed is:

1. A hinge comprising:

a hinge body adapted to be anchored to one of a stationary support structure or a closing element and a pivot defining a first axis adapted to be anchored to the other one of the stationary support structure or the closing element, the pivot and the hinge body being reciprocally coupled to allow the closing element to rotate between an open position and a closed position;

a working chamber within the hinge body defining a second axis perpendicular to the first axis, the working chamber including a bottom wall;

a plunger element sliding within the working chamber along the second axis between a position proximal to the bottom wall of the working chamber and a position distal from the bottom wall, the plunger element comprising a cylindrical body;

wherein the working chamber further includes a working fluid acting on the plunger element for hydraulically damping the action thereof, the cylindrical body being inserted into the working chamber for dividing thereof in a first variable volume compartment and a second variable volume compartment in fluidic communication to each other;

wherein the pivot includes a pinion member including a plurality of first shaped teeth, the plunger element including a rack member comprising a plurality of second countershaped teeth;

wherein the first shaped teeth of the pinion member and the second countershaped teeth of the rack member are operatively coupled each other so that the rotation of the pivot around the first axis corresponds to the sliding of the plunger element along the second axis between the proximal position and the distal position;

wherein the pivot includes an end connecting portion adapted to be fixed to the other one of the stationary support structure and the closing element and a central operating portion comprising the pinion member, the first shaped teeth being distributed along the whole circumferential periphery of the operating portion;

wherein the plunger element further includes an elongated element unitary with the cylindrical body, the elongated element extending parallel to the second axis, the elongated element including the second countershaped teeth to define the rack member;

wherein the operating portion of the pivot lays along the second axis, the elongated element defining a third axis parallel to the second axis and offset therefrom.

2. The hinge according to claim 1, wherein the pinion member and the rack member are mutually configured so as to allow the pivot or the working chamber to rotate for at least 180°.

3. The hinge according to claim 1, wherein the cylindrical body includes a first passage to allow the passage of the working fluid between the first variable volume compartment and the second variable volume compartment upon one of the opening or closing of the closing element, a circuit being provided within the hinge body for the passage of the working fluid between the first variable volume compartment and the second variable volume compartment upon the other of the opening or closing of the closing element.

4. The hinge according to claim 3, wherein the cylindrical body further includes a valve member interacting with the first passage to selectively allow the passage of the working fluid through the first passage upon one of the closing or opening of the closing element, the valve member being adapted to prevent the passage of the working fluid through the first passage upon the other one of the closing or opening of the closing element in order to force the passage of the working fluid through the circuit.

5. The hinge according to claim 4, wherein the valve member comprise a non-return valve element interacting with the first passage to allow the passage of the working fluid from the first variable volume compartment to the second variable volume compartment during the opening of the closing element and to prevent backflow of the working fluid during the closing of the closing element.

6. The hinge according to claim 3, wherein the circuit includes an adjusting screw inserted through the hinge body, the adjusting screw comprising a first upper threaded end screwed in a corresponding first upper counterthreaded connecting portion of the hinge body and a second lower end slidably inserted in a corresponding second lower guide portion of the hinge body.

7. The hinge according to claim 6, wherein the second lower end includes a hollow seat housing a substantially frustoconical element coaxially inserted therein, the adjusting screw including a first opening for the inlet or the outlet of the working fluid, the inner surface of the hollow seat facing the outer surface of the substantially frustoconical element to define an interspace therebetween which is fluidically connected to the first opening for the inlet or the outlet of the working fluid and to the circuit, the interspace being interposed therebetween.

8. The hinge according to claim 7, wherein the hollow seat has a substantially cylindrical shape, the substantially frustoconical element having the smaller diameter end faced to the first opening for the inlet or the outlet of the working fluid so that the unscrewing or the screwing of the first upper end of the adjusting screw from or in the first upper connecting portion of the hinge body corresponds to the mutual distancing or approaching of the substantially frustoconical element and the adjusting screw, so as to define an adjusting valve for adjusting the passage of the working fluid.

9. The hinge according to claim 8, wherein the adjusting screw includes a curved concave outer surface located between the first upper threaded end and the second lower end adapted to engage the curved convex outer surface of the cylindrical body.

10. The hinge according to claim 1, wherein the first variable volume compartment and the second variable volume compartment are configured to have in correspondence with the closed position of the closing element respectively the maximum volume and the minimum volume, the plunger element including a elastic counteracting member into the first variable volume compartment.

11. A hydraulic check hinge comprising:

a hinge body adapted to be anchored to one of a stationary support structure or a closing element and a pivot defining a first axis adapted to be anchored to the other one of the stationary support structure or the closing element, the pivot and the hinge body being reciprocally coupled to allow the closing element to rotate between an open position and a closed position;

a working chamber within the hinge body defining a second axis perpendicular to the first axis, the working chamber including a bottom wall;

a plunger element sliding within the working chamber along the second axis between a position proximal to the bottom wall of the working chamber and a position distal from the bottom wall, the plunger element comprising a cylindrical body;

wherein the pivot includes a pinion member including a plurality of first shaped teeth, the plunger element including a rack member comprising a plurality of second countershaped teeth;

wherein the first shaped teeth of the pinion member and the second countershaped teeth of the rack member are operatively coupled each other so that the rotation of the pivot around the first axis corresponds to the sliding of the plunger element along the second axis between the proximal position and the distal position;

wherein the pivot includes an end connecting portion adapted to be fixed to the other one of the stationary support structure and the closing element and a central operating portion comprising the pinion member;

wherein the plunger element further includes an elongated element unitary with the cylindrical body, the elongated element extending parallel to the second axis, the elongated element including the second countershaped teeth to define the rack member;

wherein the operating portion of the pivot lays along the second axis, the elongated element defining a third axis parallel to the second axis and offset therefrom;

wherein the working chamber is free of counteracting elastic means, the working chamber further including a working fluid acting on the plunger element for hydraulically damping the action thereof, the cylindrical body being inserted into the working chamber for dividing thereof in a first variable volume compartment and a second variable volume compartment in fluidic communication to each other;

wherein the cylindrical body includes a first passage to allow the passage of the working fluid between the first variable volume compartment and the second variable volume compartment upon the opening of the closing element, a damping circuit being provided within the hinge body for the passage of the working fluid between the first variable volume compartment and the second variable volume compartment upon the closing of the closing element.

12. The hinge according to claim 11, wherein the working chamber includes a first abutment surface and a second abutment surface, the plunger element being in contact with the first abutment surface when the closing element is in the closed position, the plunger element being in contact with the second abutment surface when the closing element is in the open position.

13. The hinge according to claim 11, wherein the cylindrical body further includes a valve member interacting with the first passage to selectively allow the passage of the working fluid through the first passage upon one of the closing or opening of the closing element, the valve member being adapted to prevent the passage of the working fluid through the first passage upon the other one of the closing or opening of the closing element in order to force the passage of the working fluid through the circuit.

14. The hinge according to claim 13, wherein the valve member comprise a non-return valve element interacting with the first passage to allow the passage of the working fluid from the first variable volume compartment to the second variable volume compartment during the opening of the closing element and to prevent backflow of the working fluid during the closing of the closing element.

15. The hinge according to claim 11, wherein the circuit includes an adjusting screw inserted through the hinge body, the adjusting screw comprising a first upper threaded end screwed in a corresponding first upper counterthreaded connecting portion of the hinge body and a second lower end slidably inserted in a corresponding second lower guide portion of the hinge body.

16. The hinge according to claim 15, wherein the second lower end includes a hollow seat housing a substantially frustoconical element coaxially inserted therein, the adjusting screw including a first opening for the inlet or the outlet of the working fluid, the inner surface of the hollow seat facing the outer surface of the substantially frustoconical element to define an interspace therebetween which is fluidically connected to the first opening for the inlet or the outlet of the working fluid and to the circuit, the interspace being interposed therebetween.

17. The hinge according to claim 16, wherein the hollow seat has a substantially cylindrical shape, the substantially frustoconical element having the smaller diameter end faced to the first opening for the inlet or the outlet of the working fluid so that the unscrewing or the screwing of the first upper end of the adjusting screw from or in the first upper connecting portion of the hinge body corresponds to the mutual distancing or approaching of the substantially frustoconical element and the adjusting screw, so as to define an adjusting valve for adjusting the passage of the working fluid.

18. The hinge according to claim 17, wherein the first variable volume compartment and the second variable volume compartment are configured to have in correspondence with the closed position of the closing element respectively the maximum volume and the minimum volume.

19. A hydraulic check hinge comprising:

a hinge body adapted to be anchored to one of a stationary support structure or a closing element and a pivot defining a first axis adapted to be anchored to the other one of the stationary support structure or the closing element, the pivot and the hinge body being reciprocally coupled to allow the closing element to rotate between an open position and a closed position;

a working chamber within the hinge body defining a second axis perpendicular to the first axis, the working chamber including a bottom wall;

a plunger element sliding within the working chamber along the second axis between a position proximal to the bottom wall of the working chamber and a position distal from the bottom wall, the plunger element comprising a cylindrical body;

wherein the pivot includes a pinion member including a plurality of first shaped teeth, the plunger element including a rack member comprising a plurality of second countershaped teeth;

wherein the first shaped teeth of the pinion member and the second countershaped teeth of the rack member are operatively coupled each other so that the rotation of the pivot around the first axis corresponds to the sliding of the plunger element along the second axis between the proximal position and the distal position;

wherein the pivot includes an end connecting portion adapted to be fixed to the other one of the stationary support structure and the closing element and a central operating portion comprising the pinion member;

wherein the plunger element further includes an elongated element unitary with the cylindrical body, the elongated element extending parallel to the second axis, the elongated element including the second countershaped teeth to define the rack member;

wherein the operating portion of the pivot lays along the second axis, the elongated element defining a third axis parallel to the second axis and offset therefrom;

wherein the hinge includes a restoring elastic counteracting member, the working chamber further including a working fluid acting on the plunger element for hydraulically damping the action thereof, the cylindrical body being inserted into the working chamber for dividing thereof in a first variable volume compartment and a second variable volume compartment in fluidic communication to each other;

wherein the cylindrical body includes a first passage to allow the passage of the working fluid between the first variable volume compartment and the second variable volume compartment upon the opening of the closing element, a damping circuit being provided within the hinge body for the passage of the working fluid between the first variable volume compartment and the second variable volume compartment upon the closing of the closing element.

20. The hinge according to claim 19, wherein the working chamber includes a first abutment surface and a second abutment surface, the plunger element being in contact with the first abutment surface when the closing element is in the closed position, the plunger element being in contact with the second abutment surface when the closing element is in the open position.

* * * * *